US010475364B2

(12) United States Patent
Xi et al.

(10) Patent No.: US 10,475,364 B2
(45) Date of Patent: Nov. 12, 2019

(54) COLOR FILM SUBSTRATE, DISPLAY PANEL AND DISPLAY DEVICE THEREOF

(71) Applicants: Shanghai AVIC OPTO Electronics Co., Ltd., Shanghai (CN); Tianma Micro-electronics Co., Ltd., Shenzhen (CN)

(72) Inventors: Kerui Xi, Shanghai (CN); Fan Tian, Shanghai (CN); Yewen Wang, Shanghai (CN); Lingling Zhang, Shanghai (CN); Huailing Zheng, Shanghai (CN)

(73) Assignees: Shanghai AVIC OPTO Electronics Co., Ltd. Tianma Micro-electronics Co., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 271 days.

(21) Appl. No.: 15/055,741

(22) Filed: Feb. 29, 2016

(65) Prior Publication Data

US 2017/0148365 A1 May 25, 2017

(30) Foreign Application Priority Data

Nov. 23, 2015 (CN) ..... 2015 1 0821820

(51) Int. Cl.
*G09G 3/20* (2006.01)

(52) U.S. Cl.
CPC ... *G09G 3/2003* (2013.01); *G09G 2300/0452* (2013.01); *G09G 2300/0465* (2013.01); *G09G 2330/00* (2013.01)

(58) Field of Classification Search
CPC ..... G09G 2300/0452; G09G 3/2003; G09G 2300/0465; G09G 3/2074; G09G 2320/0233; G09G 2320/0242; G09G 3/3607; G09G 3/3413; G02F 2201/52; G02F 1/133514; G02F 1/134336; G02F 1/134309; H01L 27/3213
See application file for complete search history.

(56) References Cited

U.S. PATENT DOCUMENTS

2004/0046725 A1 3/2004 Lee
2005/0116615 A1* 6/2005 Matsumoto ..... H01L 27/3213 313/500
2005/0128413 A1* 6/2005 Son ..... G02F 1/134363 349/143

(Continued)

FOREIGN PATENT DOCUMENTS

CN 1484071 A 3/2004
CN 1836188 A 9/2006

(Continued)

*Primary Examiner* — Gerald Johnson
(74) *Attorney, Agent, or Firm* — Anova Law Group PLLC

(57) ABSTRACT

A color film substrate, a display panel and a display panel are provided. The display panel comprises a plurality of pixels arranged in a matrix. Each of the plurality of pixels includes a first sub-pixel and a plurality of second pixels. The first sub-pixel has a white color, and the plurality of second pixels has a plurality of colors different from the white color. The first sub-pixel having the white color has a reduced effective aperture area compared with the plurality of sub-pixels having the plurality of colors different from the white color.

20 Claims, 6 Drawing Sheets

(56) References Cited

U.S. PATENT DOCUMENTS

2005/0140906 A1* 6/2005 Baek ..... G02F 1/133514 349/144
2006/0262262 A1* 11/2006 Kim ..... G02F 1/134309 349/139
2008/0272997 A1* 11/2008 Shin ..... G02F 1/134336 345/87
2009/0322215 A1* 12/2009 Sung ..... H01L 27/3211 313/504
2010/0001988 A1* 1/2010 Kim ..... G09G 3/3614 345/214
2013/0070002 A1* 3/2013 Hisada ..... F21V 9/08 345/690
2014/0231790 A1* 8/2014 Fujino ..... H01L 51/5284 257/40
2015/0090988 A1* 4/2015 Ooka ..... H01L 51/5228 257/40
2015/0144946 A1* 5/2015 Kusunoki ..... G02F 1/133621 257/43
2016/0027357 A1* 1/2016 Guo ..... G09G 3/32 345/694
2016/0033816 A1* 2/2016 Yoon ..... G02F 1/133512 349/108
2016/0181336 A1* 6/2016 Tokuda ..... H04N 9/30 257/40
2016/0357061 A1* 12/2016 Bang ..... G02F 1/133514
2018/0231847 A1* 8/2018 Qin ..... G02F 1/134309

FOREIGN PATENT DOCUMENTS

CN 1869772 A 11/2006
CN 102749751 A 10/2012
CN 202736924 U 2/2013
CN 104376817 A 2/2015
KR 20080111939 A 12/2008

* cited by examiner

COLOR FILM SUBSTRATE, DISPLAY PANEL AND DISPLAY DEVICE THEREOF

CROSS-REFERENCES TO RELATED APPLICATIONS

This application claims the priority of Chinese patent application No. CN201510821820.1, filed on Nov. 23, 2015, the entire content of which is incorporated herein by reference.

BACKGROUND

To improve a backlight efficiency, many display devices adopt a pixel design or a pixel layout in which a white sub-pixel is introduced. Through utilizing a high light transmittance of the white sub-pixel, the display device achieves a high brightness and, meanwhile, the backlight efficiency is significantly improved.

FIG. 1 illustrates a top view of a conventional display panel having white sub-pixels. As shown in FIG. 1, the display panel 1 includes a plurality of pixels or pixel regions P arranged in a pixel matrix, i.e., a two-dimensional pixel matrix. In a row direction of the pixel matrix, each pixel P includes a red sub-pixel R, a green sub-pixel G, a blue sub-pixel B and a white sub-pixel W, which are arranged in a 1×4 array. In particular, an effective aperture area SR of the red sub-pixel R, an effective aperture area SG of the green sub-pixel G, an effective aperture area SB of the blue sub-pixel B, and an effective aperture area SW of the white sub-pixel W are substantially the same. That is, the white sub-pixel W occupies a substantially same area in the pixel P as the other sub-pixels (i.e., the red sub-pixel R, the green sub-pixel G or the blue sub-pixel B).

However, when the display panel is displaying an image or a video, there is a possibility of 30% to 50% that the white sub-pixel W is switched on. That is, there is a possibility of 50% to 70% that the white sub-pixel W is switched off. Thus, most of the time the white sub-pixel W does not transmit the backlight, and the high light transmittance of the white sub-pixel W is wasted.

The disclosed color film substrate, display panel and display device are directed to solve one or more problems in the art.

BRIEF SUMMARY OF THE DISCLOSURE

One aspect of the present disclosure provides a display panel. The display panel comprises a plurality of pixels arranged in a matrix. Each of the plurality of pixels includes a first sub-pixel and a plurality of second pixels. The first sub-pixel has a white color, and the plurality of second pixels has a plurality of colors different from the white color. The first sub-pixel having the white color has a reduced effective aperture area compared with the plurality of sub-pixels having the plurality of colors different from the white color.

One aspect of the present disclosure provides a color film substrate. The color film substrate comprises a substrate having a plurality of pixels arranged in a matrix, and a light-shielding layer confining a first sub-pixel and a plurality of second pixels in each of the plurality of pixels. The first sub-pixel has a white color, and the plurality of second pixels has a plurality of colors different from the white color. The first sub-pixel having the white color has a reduced effective aperture area compared with the plurality of sub-pixels having the plurality of colors different from the white color.

One aspect of the present disclosure provides a display device. The display device comprises a display panel having a plurality of pixels arranged in a matrix. Each of the plurality of pixels includes a first sub-pixel and a plurality of second pixels. The first sub-pixel has a white color, and the plurality of second pixels has a plurality of colors different from the white color. The first sub-pixel having the white color has a reduced effective aperture area compared with the plurality of sub-pixels having the plurality of colors different from the white color.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the invention, which are illustrated in the accompanying drawings. Hereinafter, embodiments consistent with the disclosure will be described with reference to drawings. Wherever possible, the same reference numbers will be used throughout the drawings to refer to the same or like parts. It is apparent that the described embodiments are some but not all of the embodiments of the present invention. Based on the disclosed embodiments, persons of ordinary skill in the art may derive other embodiments consistent with the present disclosure, all of which are within the scope of the present invention.

The present disclosure provides a display panel, a color film substrate and a display device, which are described with figures. Shapes and dimension of the disclosed display panel/color film substrate/display device in the figures are only for illustrative purposes, which are not intended to limit the scope of the present invention.

Figure 1:
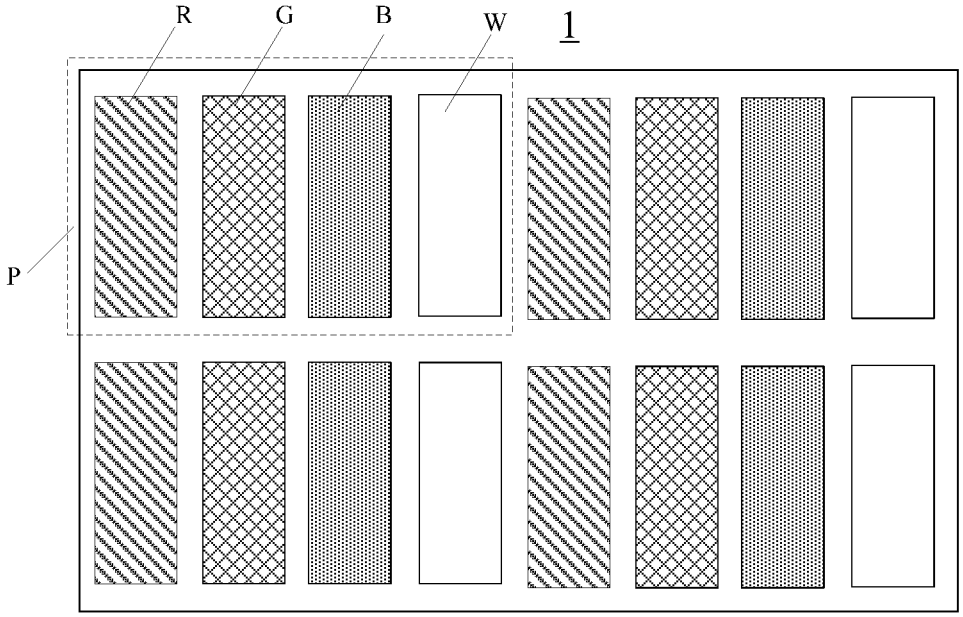
FIG. 1(Prior Art)
FIG. 1 illustrates a top view of a conventional display panel having a white sub-pixel.
Figure 2:
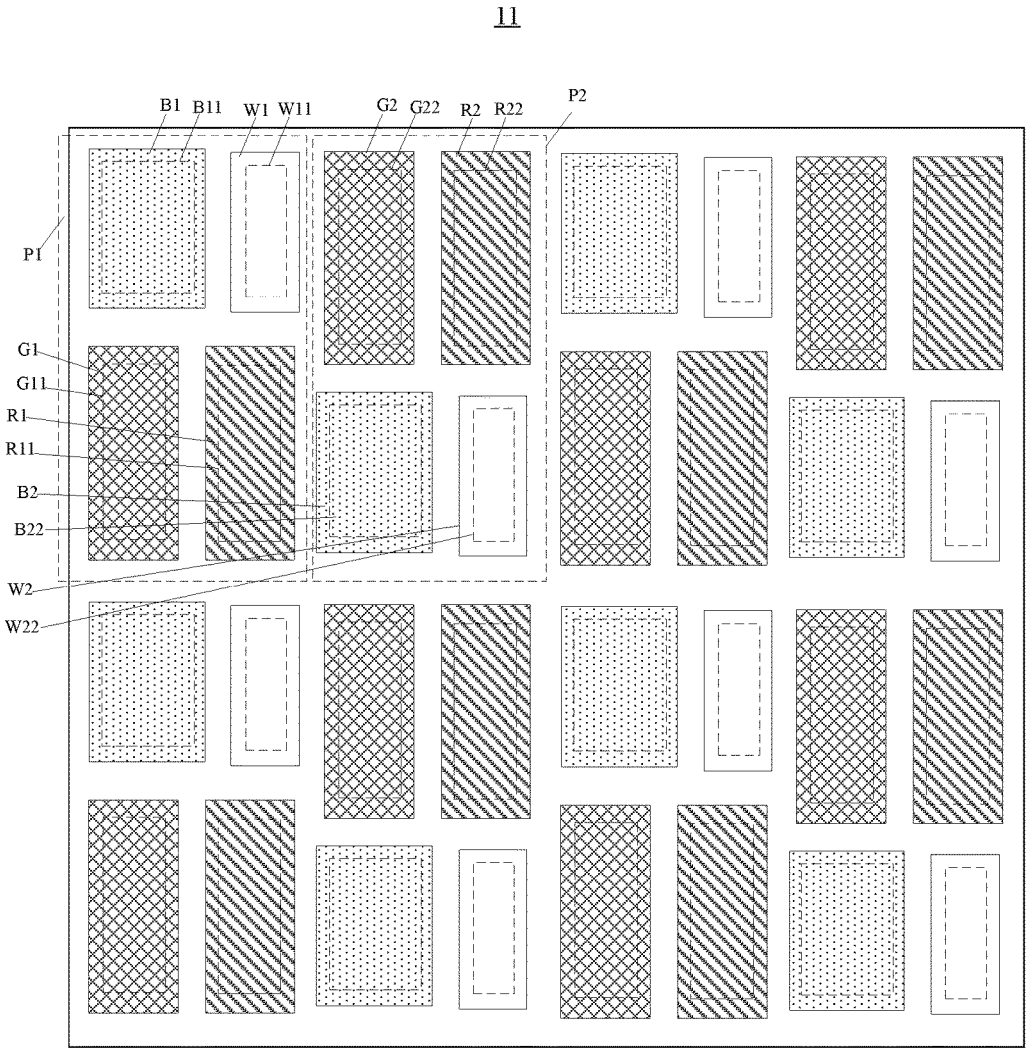
FIG. 2 illustrates a top view of an exemplary display panel consistent with disclosed embodiments.
Figure 3:
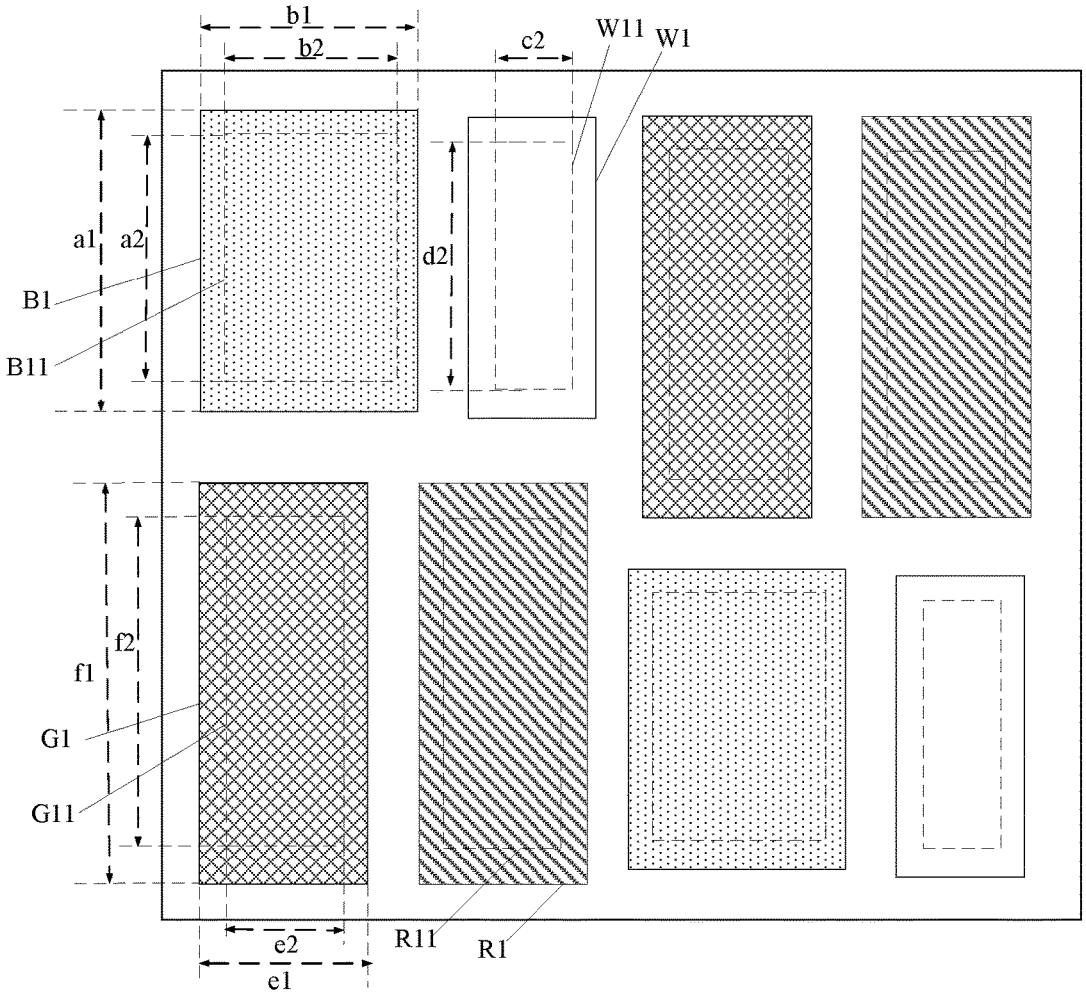
FIG. 3 illustrates enlarged views of a pixel P1 and a pixel P2 in an exemplary display panel in FIG. 2 consistent with disclosed embodiments.

FIG. 2 illustrates a top view of an exemplary display panel consistent with disclosed embodiments. FIG. 3 illustrates enlarged views of a pixel P1 and a pixel P2 in an exemplary display panel in FIG. 2 consistent with disclosed embodiments. As shown in FIG. 2 and FIG. 3, the display panel may include a plurality of pixels or pixel regions P1 and P2, which may be arranged in a matrix, i.e., a two-dimensional pixel matrix.

The pixel P1 may include four sub-pixels: a red sub-pixel R1, a green sub-pixels G1, a blue sub-pixel B1 and a white sub-pixel W1. In particular, in one row of the pixel matrix, the blue sub-pixel B1 and the white sub-pixel W1 may be adjacently disposed, and in another adjacent row of the pixel matrix, the red sub-pixel R1 and the green sub-pixels G1 may also be adjacently disposed. That is, in one pixel P1, the four sub-pixels may be arranged in a 2×2 array.

Further, the pixel P2 adjacent to the pixel P1 may also include sub-pixels arranged in a sub-pixel matrix: a red sub-pixel R2, a green sub-pixels G2, a blue sub-pixel B2 and a white sub-pixel W2, which may be similarly disposed in the pixel P2 as the four sub-pixels in the pixel P1. That is, in one pixel P2, the four sub-pixels may be arranged in a 2×2 array.

It should be noted that, in the disclosed embodiments, for the pixel P1 and pixel P2 adjacent to the pixel P1 in the row direction of the pixel matrix, the sub-pixels having a same color may be arranged in opposite positions in the pixel P1 and the adjacent pixel P2, respectively. For example, considering the eight sub-pixels, i.e., the four sub-pixels in the pixel P1 and the four sub-pixels in the adjacent pixel P2, are arranged in a 2×4 array. The blue sub-pixel B1 of the pixel P1 may be disposed at the first row and the first column in the 2×4 array, while the blue sub-pixel B2 of the pixel P2 may be disposed at the second row and the third column in the 2×4 array. That is, in two pixels which are adjacent to each other in the row direction of the pixel matrix, the two blue sub-pixels may be disposed in different rows and different columns.

Further, the white sub-pixel W1 of the pixel P1 may be disposed at the first row and the second column in the 2×4 array, while the white sub-pixel W2 of the pixel P2 may be disposed at the second row and the fourth column in the 2×4 array. That is, in two pixels which are adjacent to each other in the row direction of the pixel matrix, the two white sub-pixels may be disposed in different rows and different columns.

To enable the white sub-pixel to compensate the blue sub-pixel in terms of color saturation as well as to prevent a color shift in the display panel, the blue sub-pixel and the white sub-pixel may be adjacently disposed in one pixel. In the disclosed embodiments, the blue sub-pixel and the white sub-pixel may be adjacently disposed in the row direction of the pixel matrix.

Further, the two red sub-pixels (i.e., the red sub-pixel R1 and the red sub-pixel R2) in two adjacent pixels (i.e., the pixel P1 and the adjacent pixel P2) and two green sub-pixels (i.e., the green sub-pixel G1 and the green sub-pixel G2) in two adjacent pixels (i.e., the pixel P1 and the adjacent pixel P2) may also be similarly disposed in the 2×4 array.

The red sub-pixel R1 of the pixel P1 may be disposed at the first row and the second column in the 2×4 array, while the red sub-pixel R2 of the pixel P2 may be disposed at the first row and the fourth column in the 2×4 array. That is, in two pixels which are adjacent to each other in the row direction of the pixel matrix, the two red sub-pixels may be disposed in different rows and different columns.

The green sub-pixel G1 of the pixel P1 may be disposed at the second row and the first column in the 2×4 array, while the green sub-pixel G2 of the pixel P2 may be disposed at the second row and the third column in the 2×4 array. That is, in two pixels which are adjacent to each other in the row direction of the pixel matrix, the two green sub-pixels may be disposed in different rows and different columns.

In the above-mentioned 2×4 array, the two sub-pixels with a same color may be considered to be diagonally disposed.

On the other hand, the pixel P1 and pixel P2 adjacent to the pixel P1 in the row direction of the pixel matrix may be considered as a pixel unit. Thus, the display panel may include a plurality of pixel units. The pixel unit may be any display unit in the display panel, displaying an image or an image element. Each pixel unit may include eight sub-pixels arranged in a 2×4 array: two red sub-pixels, two green sub-pixels, two blue sub-pixels and two white sub-pixels. The two sub-pixels with a same color may be diagonally disposed, i.e., the two sub-pixels with a same color may be disposed in different rows and different columns in the 2×4 array.

The display panel 1 having the disclosed pixel layout may utilize certain algorithms to improve the resolution of the display panel 1.

In general, an area of an effective aperture (i.e., an effective region of transmitting light) of a sub-pixel divided by an area of a sub-pixel may be referred as an aperture ratio of the sub-pixel. A larger aperture ratio usually indicates a higher light transmittance. An area of an effective aperture is also called as an effective aperture area in the follow description, and an area of a sub-pixel is also called as a sub-pixel area in the follow description.

Further, the effective aperture area of the sub-pixel may be referred as the area of the sub-pixel excluding opaque regions occupied by wires, light-shielding layers and thin film transistors. For example, as shown in FIG. 2, the area of the blue sub-pixel B1 in the pixel P1 may be S(B1)=a1×b1, where a1 is a full length of the blue sub-pixel B1 and b1 is a full width of the blue sub-pixel B1. An effective aperture of the blue sub-pixel B1 may be B11 (indicated by the dash rectangle in the blue sub-pixel B1 in FIG. 2) and the area of B11 may be S(B11)=a2×b2, where a2 is an effective aperture length of the blue sub-pixel B1 and b2 is an effective aperture width of the blue sub-pixel B1.

When the display panel is displaying an image or a video, the white sub-pixel may be only switched on at a possibility of approximately 50%, i.e., an opening possibility of the white sub-pixel may be approximately 50%. When the white sub-pixel is switched off, the white sub-pixel may not transmit the light, which may result a waste of the effective aperture of the white sub-pixel.

Accordingly, in the disclosed embodiments, given a constant total effective aperture area of the pixel, the effective aperture area of the white sub-pixel may be reduced and the opening possibility of the white sub-pixel may be increased, for example, to ~70%-90%. Thus, on one hand, the brightness of the display panel and the NTSC color gamut saturation may be ensured. On the other hand, the reduced effective aperture area of the white sub-pixel may compensate the effective aperture areas of the other sub-pixels. That is, the effective aperture areas of the other sub-pixels may be increased, and the effective aperture area of the entire pixel may also be increased accordingly. When the opening possibility of the white sub-pixel is approximately 80%, the display panel may have a light transmittance approximately above 6% and a NTSC color gamut approximately above 71.4%.

In the disclosed embodiments, a ratio between the effective aperture area of the white sub-pixel and the effective aperture area of the blue sub-pixel may be approximately 0.3 to 0.7, such that the light transmittance of the display panel may be improved, the color shift may be reduced, and the cost of the display panel may also be reduced.

Referring to FIG. 2, the pixel P1 may include four sub-pixels having a same shape, i.e., the red sub-pixel R1, the green sub-pixels G1, the blue sub-pixel B1 and the white sub-pixel W1. The four sub-pixels may all have a rectangular shape, which is only for illustrative purposes and is not intended to limit the scope of the present invention. According to pixel designs of practical products, each sub-pixel may have a different shape, such as a circular shape, a square shape, a triangular shape, or a rhombic shape.

In the disclosed embodiments, for the sub-pixel with a rectangular shape, the area of the effective aperture B11 of the blue sub-pixel B1 (indicated by the dashed rectangle in the blue sub-pixel B1 in FIG. 2) may be S(B11)=a2×b2, where a2 is an effective aperture length of the blue sub-pixel B1 and a2 may be approximately 20 μm, b2 is an effective aperture width of the blue sub-pixel B1 and b2 may be approximately 16 μm. Thus, the area S(B11) of the effective aperture B11 of the blue sub-pixel B1 may be approximately 320 $\mu m^2$.

Further, the white sub-pixel W1 may have an effective aperture W11 (indicated by the dashed rectangle in the white sub-pixel W1 in FIG. 2), the area of the effective aperture W11 may be S(W11)=d2×c2, where d2 is an effective aperture length of the white sub-pixel W1 and d2 may be approximately 16 μm, c2 is an effective aperture width of the white sub-pixel W1 and c2 may be approximately 10 μm. Thus, the area S(W11) of the effective aperture W11 of the white sub-pixel W1 may be approximately 160 $\mu m^2$.

Because the red sub-pixel R1 and the green sub-pixel G1 may be adjacently disposed in the row direction of the display pixel matrix, the red sub-pixel R1 and the green sub-pixel G1 may be designed to have a same shape, a same area, a same effective aperture area and a same effective aperture shape. Thus, the pixel layout may be optimized.

To further optimize the pixel layout, a ration between an effective aperture length of the red sub-pixel (or the green sub-pixel) and an effective aperture width of the red sub-pixel (or the green sub-pixel) may be approximately 2:1 to 3.5:1, and a preferred ratio may be approximately 3:1 to 3.5:1. Meanwhile, a ratio between a full length of the red sub-pixel (or the green sub-pixel) and a full width of the red sub-pixel (or the green sub-pixel) may be approximately 2:1 to 3.5:1, and a preferred ratio may be approximately 3:1 to 3.5:1.

In particular, the green sub-pixel G1 may have an effective aperture G11 (indicated by the dashed rectangle in the green sub-pixel G1 in FIG. 2), and the area of the effective aperture G11 may be S(G11)=f2×e2, where f2 is an effective aperture length of the green sub-pixel G1 and f2 may be approximately 32 μm, e2 is an effective aperture width of the green sub-pixel G1 and e2 may be approximately 10 μm. Thus, the area S(G11) of the effective aperture G11 of the green sub-pixel G1 may be approximately 320 $\mu m^2$. Similarly, the red sub-pixel R1 may have an effective aperture R11 (indicated by the dashed rectangle in the red sub-pixel R1 in FIG. 2), and the area S(R11) of the effective aperture R11 of the red sub-pixel R1 may also be approximately 320 $\mu m^2$.

Thus, a ratio among the area of the effective aperture R11 of the red sub-pixel R1, the area of the effective aperture G11 of the green sub-pixel G1, the area of the effective aperture B11 of the blue sub-pixel B1, and the area of the effective aperture W11 of the white sub-pixel W1 may be 1:1:1:0.5. That is, S(R11):S(G11):S(B11):S(W11)=1:1:1:0.5. Given a constant total effective aperture, reducing the effective aperture area of the white sub-pixel may increase the effective aperture areas of the other three sub-pixels. That is, through reducing the effective aperture area of the white sub-pixel to half of the effective aperture area of the other three sub-pixels, the effective aperture areas of the other three sub-pixels may be increased. On the other hand, the opening possibility of the white sub-pixel may be increased to approximately 80%. Thus, a display device with the disclosed display panel may have a total light transmittance of approximately 6.2%.

Further, a display device with a conventional display panel often has a NTSC color gamut of approximately 71.4%. The conventional display panel includes a plurality of pixels, and each pixel includes four sub-pixels having a same effective aperture area. However, the display device with the disclosed display panel may have a NTSC color gamut of approximately 71.5%, which is almost equal to the NTSC color gamut of the display device with the conventional display panel. That is, even the NTSC color gamut of the white sub-pixel is reduced, the display device with the disclosed display panel may still keep a good NTSC color gamut level (i.e., a wide NTSC color gamut), which may effectively prevent the color shift.

In the disclosed embodiments, the effective aperture of the sub-pixel may have a rectangular shape, which is only for illustrative purposes and is not intended to limit the scope of the present invention. According to pixel designs of practical display devices, the effective aperture of the sub-pixel may have a circular shape, a square shape, a triangular shape, and a rhombic shape, etc. Further, different sub-pixels may also have effective apertures in different shapes.

Figure 4:
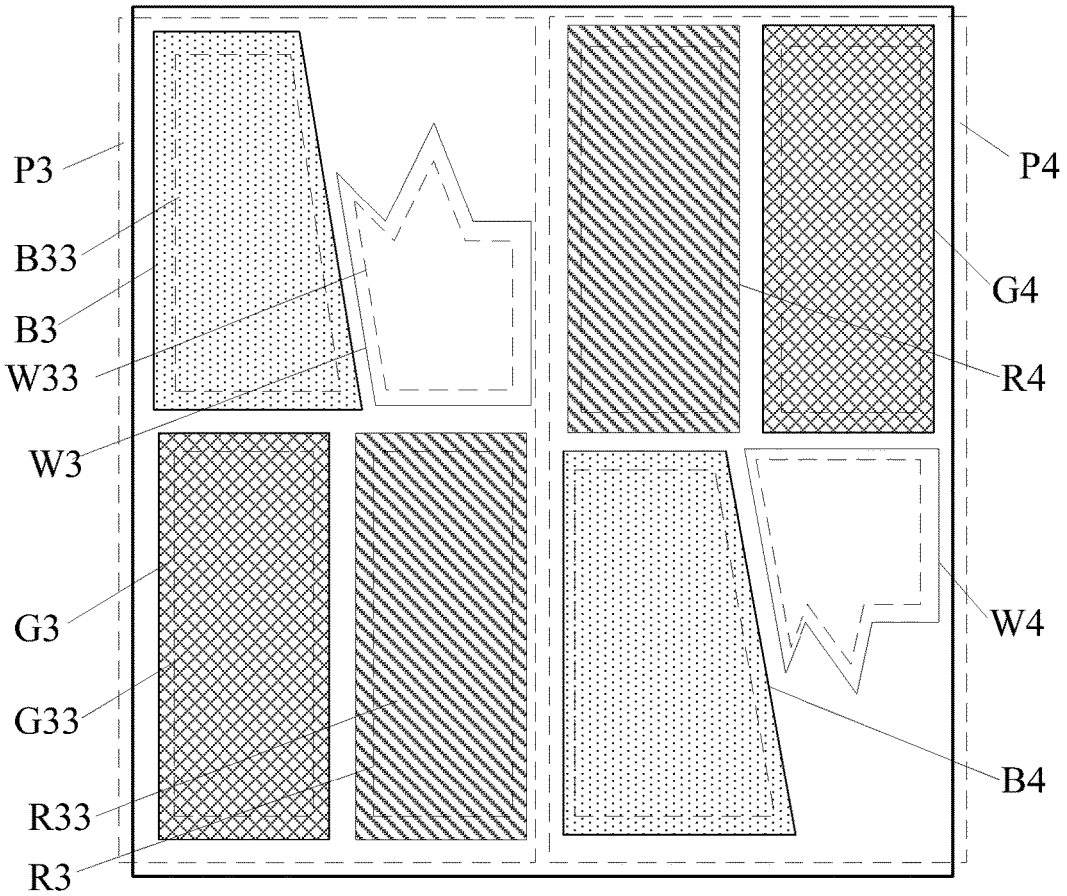
FIG. 4 illustrates a top view of another exemplary display panel consistent with disclosed embodiments.

FIG. 4 illustrates a top view of another exemplary display panel consistent with disclosed embodiments. As shown in FIG. 4, the display panel may include a plurality of pixels or pixel regions P3 and P4, which may be alternately arranged in a pixel matrix, i.e., a pixel matrix. Each pixel P3 may include four sub-pixels: a red sub-pixel R3, a green sub-pixels G3, a blue sub-pixel B3 and a white sub-pixel W3. The four sub-pixels (i.e., R3, G3, B3 and W3) may be similarly disposed in the pixel P3 as the four sub-pixels (i.e., R1, G1, B1 and W1) in the pixel P1 in FIG. 2. That is, the red sub-pixel R3 and the green sub-pixels G3 may be disposed in a same row, and the blue sub-pixel B3 and the white sub-pixel W3 may also be disposed in a same row which is adjacent to the row having red sub-pixel R3 and the green sub-pixels G3. However, in certain other embodiments, the red sub-pixel R3 and the green sub-pixels G3 may be disposed in different rows, and the blue sub-pixel B3 and the white sub-pixel W3 may also be disposed in different rows.

Further, each pixel P4 may also include four sub-pixels: a red sub-pixel R4, a green sub-pixels G4, a blue sub-pixel B4 and a white sub-pixel W4. The four sub-pixels (i.e., R4, G4, B4 and W4) may be similarly disposed in the pixel P4 as the four sub-pixels (i.e., R2, G2, B2 and W2) in the pixel P2 in FIG. 2. Meanwhile, the pixel P3 and the pixel P4 adjacent to the pixel P3 in a row direction of the pixel matrix may also be disposed similarly to the pixel P1 and the pixel P2 in FIG. 2, which may not be repeated here, while certain differences are explained.

Referring to FIG. 4, in the pixel P3, the white sub-pixel W3 may have an effective aperture W33 (indicated by a dashed polygon in the white sub-pixel W3 in FIG. 4), and the blue sub-pixel B3 adjacent to the white sub-pixel W3 may have an effective aperture B33 (indicated by a dashed trapezoid in the blue sub-pixel B3 in FIG. 4). The area of the effective aperture W33 in the white sub-pixel W3 may be 0.6 of the area of the effective aperture B33 in the blue sub-pixel B3.

Further, the red sub-pixel R3 may have an effective aperture R33 (indicated by a dashed rectangle in the red sub-pixel R3 in FIG. 4), and the green sub-pixel G3 adjacent to the green sub-pixel G3 may have an effective aperture G33 (indicated by a dashed rectangle in the blue sub-pixel G3 in FIG. 4). The area of the effective aperture B33 of the blue sub-pixel B3, the area of the effective aperture R33 of the red sub-pixel R3 and the area of the effective aperture G33 of the green sub-pixel G3 may be the same.

Thus, a ratio among the area of the effective aperture B33 of the blue sub-pixel B3, the area of the effective aperture R33 of the red sub-pixel R3, the area of the effective aperture G33 of the green sub-pixel G, and the area of the effective aperture W33 in the white sub-pixel W3 may be approximately 1:1:1:0.6. A ratio among the effective aperture areas of the four sub-pixels in the adjacent pixel P4 may be the same as the ratio among the effective aperture areas of the four sub-pixels in the pixel P3, which may not be repeated here.

In the disclosed embodiments, given a constant total effective aperture area of the pixel, reducing the effective aperture area of the white sub-pixel may increase the effective aperture areas of the other three sub-pixels. That is, through reducing the effective aperture area of the white sub-pixel to approximately 0.6 of the effective aperture area of the other three sub-pixels, the effective aperture areas of the other three sub-pixels may be increased. On the other hand, an opening possibility of the white sub-pixel may be increased to approximately 70%. Thus, a display device with the disclosed display panel may have a total light transmittance of approximately 6.15%, and a NTSC color gamut of approximately 71.46%.

The white sub-pixel W3 in the pixel P3 may have an irregular polygonal shape, and the corresponding effective aperture W33 of the white sub-pixel W3 may also have an irregular polygonal shape. The blue sub-pixel B3 adjacent to the white sub-pixel W3 may have a trapezoidal shape, and the corresponding effective aperture B33 of the blue sub-pixel B3 may also have a trapezoidal shape or an irregular polygonal shape.

The red sub-pixel R3 and the green sub-pixel G3 may have a rectangular shape, respectively, and the corresponding effective aperture R33 of the red sub-pixel R3 and the corresponding effective aperture G33 of the green sub-pixel G3 may also a trapezoidal shape or an irregular polygonal shape, respectively. The four sub-pixels and corresponding effective apertures in the adjacent pixel P4 may have similar shapes as the four sub-pixels and the corresponding effective apertures in the pixel P3, which may not repeated here.

In the disclosed embodiments, the red sub-pixel, the green sub-pixel and the corresponding effective aperture may have an irregular polygonal shape, a regular polygonal shape, a circular shape, etc. For example, in a heterogeneous display, designs of the sub-pixels may be adjusted according to practical displaying requirements of a product.

The display panel may be any appropriate type of display panel, such as plasma display panel (PDP), field emission display (FED) panel, liquid crystal display (LCD) panel, organic light emitting diode (OLED) display panel, light emitting diode (LED) display panel, or other types of display panels.

Figure 5:
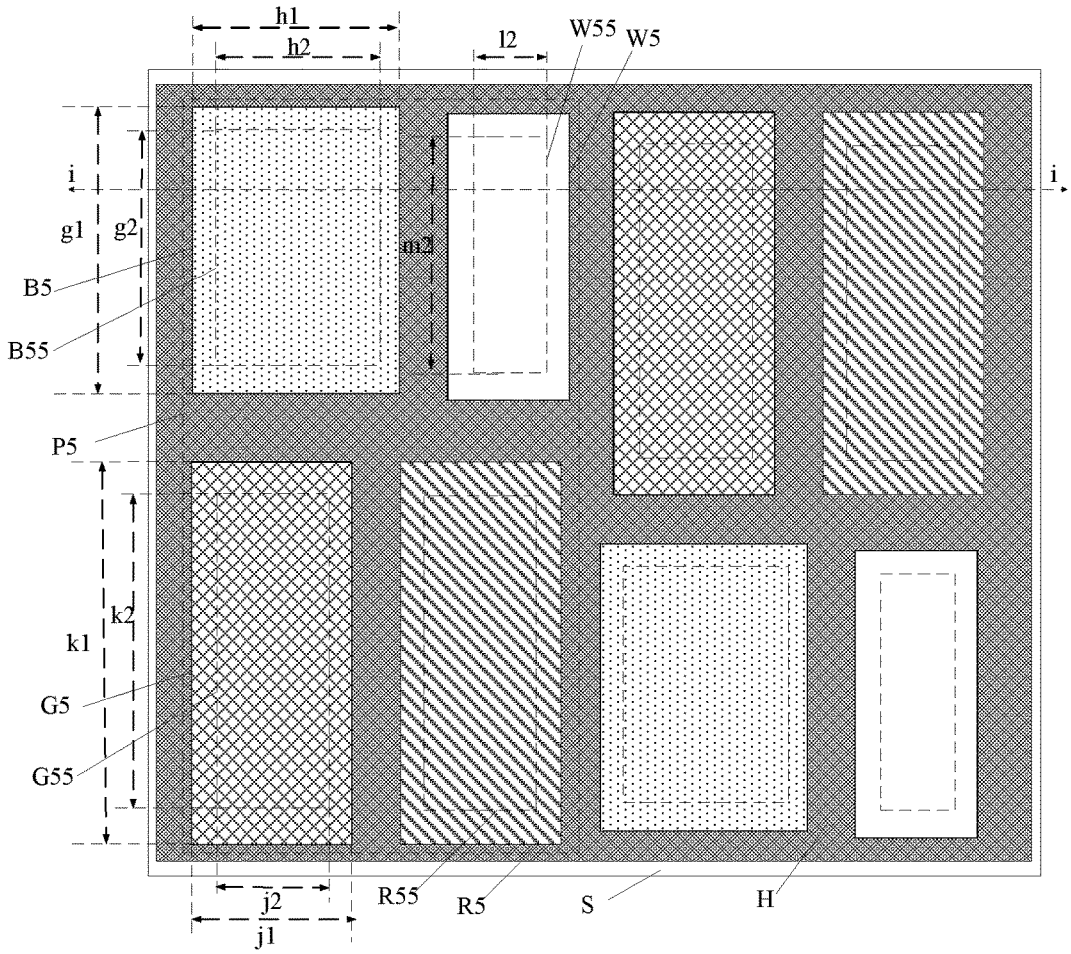
FIG. 5 illustrates a top view of an exemplary color film substrate consistent with disclosed embodiments.

Further, the present disclosure provides a color film substrate. FIG. 5 illustrates a top view of an exemplary color film substrate consistent with disclosed embodiments. As shown in FIG. 5, the color film substrate may include a substrate S. A plurality of pixels or pixel regions P5 and a light-shielding layer H may be disposed on top of the substrate S. The plurality of pixels P5 may be arranged in a pixel matrix, i.e., a pixel matrix. The light-shielding layer H, which is usually a black pixel matrix (BM), may confine a red sub-pixel R5, a green sub-pixel G5, a blue sub-pixel B5 and a white sub-pixel W5 in each pixel P5.

Figure 6:
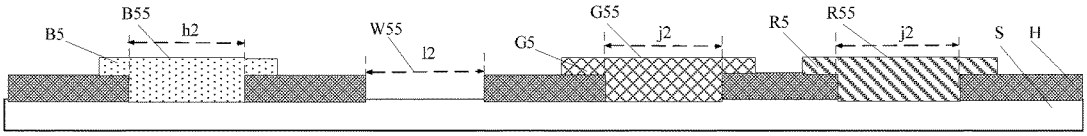
FIG. 6 illustrates the i-i sectional view of an exemplary color film substrate in FIG. 5 consistent with disclosed embodiments.

FIG. 6 illustrates the i-i sectional view of an exemplary color film substrate in FIG. 5 consistent with disclosed embodiments. In a display device, colors may be displayed through color filters which are capable of filtering light with various colors, i.e. color barriers with different colors. As shown in FIG. 6, the color film substrate may further include a plurality of red color barriers R5, a plurality of green color barriers G5 and a plurality of blue color barriers B5. The red color barrier R5, the green color barrier G5 and the blue color barrier B5 may be disposed on the red sub-pixel R5, the green sub-pixel G5 and the blue sub-pixel B5 in the pixel P5, respectively.

In the disclosed embodiments, each color barrier may fully cover the corresponding color sub-pixel. For example, in the pixel P5, an area of the red color barrier R5 may be larger than or equal to an effective aperture area R55 of the red sub-pixel, and an area of the green color barrier G5 may be larger than or equal to an effective aperture area G55 of the green sub-pixel. In particular, the red color barrier R5 and the green color barrier G5 may have a same shape, and the area of the red color barrier R5 and the area of the green color barrier G5 may be the same. Further, an area of the blue color barrier B5 may be larger than or equal to an effective aperture area B55 of the blue sub-pixel It should be noted that, to obtain a high light transmittance, a color barrier may not be disposed on the white sub-pixel W5. That is, from a fabrication process aspect, a region above the white sub-pixel W5, which is supposed to have a color barrier, may be left blank. Accordingly, a corresponding region above an effective aperture W55 of the white sub-pixel W5 may also be left blank. However, in another embodiment, a white color barrier may be disposed on the white sub-pixel W5.

Further, through setting a ratio between the effective aperture area of the white sub-pixel and the effective aperture area of the blue sub-pixel to be approximately 0.3:1 to 0.7:1, the color film substrate may achieve a light transmittance approximately above 6% and a NTSC color gamut approximately above 71.4%. Thus, the light transmittance may be improved, the color shift may be reduced, and the device cost may also be reduced.

As shown in FIG. 5 and FIG. 6, for the sub-pixels having a rectangular shape, the effective aperture B55 of the blue sub-pixel B5 (indicated by the dashed rectangle in the blue sub-pixel B5 in FIG. 5) may have an area S(B55)=g2×h2, where g2 is an effective aperture length of the blue sub-pixel B5 and g2 may be approximately 20 μm, h2 is an effective aperture width of the blue sub-pixel B5 and h2 may be approximately 16 μm. Thus, the area S(B55) of the effective aperture B55 of the blue sub-pixel B5 may be approximately 320 $\mu m^2$.

Further, the effective aperture W55 of the white sub-pixel W5 (indicated by the dashed rectangle in the white sub-pixel W5 in FIG. 5) may have an area S(W55)=m2×l2, where m2 is an effective aperture length of the white sub-pixel W5 and m2 may be approximately 16 μm, l2 is an effective aperture width of the white sub-pixel W5 and l2 may be approximately 10 μm. Thus, the area S(W55) of the effective aperture W55 of the white sub-pixel W5 may be approximately 160 $\mu m^2$.

The effective aperture G55 of the green sub-pixel G5 (indicated by the dashed rectangle in the green sub-pixel G5 in FIG. 5) may have an area S(G55)=k2×j2, where k2 is an effective aperture length of the green sub-pixel G5 and k2 may be approximately 32 μm, j2 is an effective aperture width of the green sub-pixel G5 and j2 may be approximately 10 μm. Thus, the area S(G55) of the effective aperture G55 of the green sub-pixel G5 may be approximately 320 $\mu m^2$. Similarly, the effective aperture R55 (indicated by the dashed rectangle in the red sub-pixel R5 in FIG. 5) of the red sub-pixel R5 may have an area S(R55) of approximately 320 $\mu m^2$.

Thus, a ratio among the area of the effective aperture R55 of the red sub-pixel R5, the area of the effective aperture G55 of the green sub-pixel G5, the area of the effective aperture B55 of the blue sub-pixel B5, and the area of the effective aperture W55 of the white sub-pixel W5 may be approximately 1:1:1:0.5. That is, S(R55):S(G55):S(B55):S(W55) may be approximately 1:1:1:0.5.

In the disclosed embodiments, given a constant total effective aperture area of the pixel P5, reducing the effective aperture area of the white sub-pixel may increase the effective aperture areas of the other three sub-pixels. That is, through reducing the effective aperture area of the white sub-pixel to half of the effective aperture area of the other three sub-pixels, the effective aperture areas of the other three sub-pixels may be increased. On the other hand, the opening possibility of the white sub-pixel may be increased to approximately 80%. Thus, a display device with the disclosed color film substrate and display panel thereof may achieve a total light transmittance of approximately 6.2%.

Further, a display device with a conventional color film substrate has a NTSC color gamut of approximately 71.4%. The conventional color film substrate includes a plurality of pixels, and each pixel includes four sub-pixels with a same effective aperture area. However, the display device with the disclosed color film substrate may have a NTSC color gamut of approximately 71.5%, which is almost equal to the NTSC color gamut of the display device with the color film substrate. That is, even the NTSC color gamut of the white sub-pixel is reduced, the display device with the disclosed color film substrate may still keep a good NTSC color gamut level (i.e., a wide NTSC color gamut), which may effectively prevent the color shift.

In other embodiments, the effective aperture area of the white sub-pixel may be further reduced to be approximately 0.5 to 0.6 of the effective aperture area of the other three sub-pixels, the display device having the disclosed color film substrate and display panel thereof may still have a total light transmittance of approximately 6.2% and a NTSC color gamut of approximately 71.5%.

To further optimize the pixel layout, in the disclosed embodiments, a ratio between the effective aperture length of the green sub-pixel (or the red sub-pixel) and the effective aperture width of the green sub-pixel (or the red sub-pixel) may be approximately 2:1 to 3.5:1, and a preferred ratio may be approximately 3:1 to 3.5:1. Meanwhile, a ratio between a length of the green sub-pixel (or the red sub-pixel) and a width of the green sub-pixel (or the red sub-pixel) may be approximately 2:1 to 3.5:1, and a preferred ratio may be approximately 3:1 to 3.5:1.

Referring to FIG. 5, for the pixel P5 having four sub-pixels, the pixel P5 may be considered to be a 2×2 array comprising the four sub-pixels. That is, in one pixel P5, the four sub-pixels may be arranged in a 2×2 array. In a row direction of the array, the white sub-pixel W5 may be disposed adjacent to the blue sub-pixel B5 and, meanwhile the red sub-pixel R5 may be disposed adjacent to the green sub-pixel G5.

For one pixel P5 and another pixel P5 which is adjacent to the pixel P5 in a row direction of the pixel matrix, the sub-pixels having a same color in the two pixels P5 may be disposed in opposite positions. For example, the blue sub-pixel in one pixel P5 and the blue sub-pixel in an adjacent pixel P5 may be disposed in different rows and different columns. That is, the blue color barrier corresponding to the blue sub-pixel in one pixel P5 and the blue color barrier corresponding to the blue sub-pixel in the adjacent pixel P5 may also be disposed in different rows and different columns.

The white sub-pixel in one pixel P5 and the white sub-pixel in the adjacent pixel P5 may be disposed in different rows and different columns. That is, the white color barrier corresponding to the white sub-pixel in one pixel P5 and the white color barrier corresponding to the white sub-pixel in the adjacent pixel P5 may also be disposed in different rows and different columns.

On the other hand, one pixel P5 and another pixel P5 adjacent to the pixel P1 in the row direction of the pixel matrix may be considered as a pixel unit. The pixel unit may include eight sub-pixels arranged in a 2×4 array: two red sub-pixels, two green sub-pixels, two blue sub-pixels and two white sub-pixels. For one pixel P5 and another pixel P5 which is adjacent to the pixel P5 in a row direction of the pixel matrix, the two sub-pixels with a same color in the two pixels P5 may be diagonally disposed, i.e., the two sub-pixels with a same color in the two pixels P5 may disposed in different rows and different columns in the 2×4 array. The pixel unit may be any display unit in the display panel, displaying an image or an image element.

Further, in the disclosed embodiments, each sub-pixel may have a rectangular shape, which is only for illustrative purposes and is not intended to limit the scope of the present invention. According to pixel designs of practical display devices, the sub-pixel may have a circular shape, a square shape, a triangular shape, and a rhombic shape, etc. Further, different sub-pixels may also have different shapes.

Figure 7:
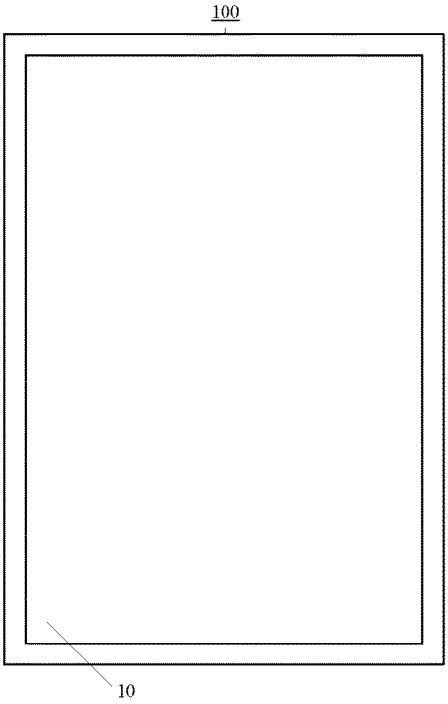
FIG. 7 illustrates an exemplary display device consistent with disclosed embodiments.

FIG. 7 illustrates an exemplary display device having consistent with disclosed embodiments. As shown in FIG. 7, the display device 100 may include a display panel 10 consistent with disclosed embodiments. The display panel 10 may be a display panel utilizing a display medium, e.g. liquid crystal (LC) display panel, or a display panel utilizing self-lighting elements, e.g. organic light-emitting diode (OLED) display panel. The details of the display device 100 may be referred to the details of the disclosed display panels, which are not explained here.

The display panel 100 may be a smartphone, a tablet, a TV, a monitor, a notebook, a digital picture frame, a GPS, etc. Further, the display panel 100 may be any product or any component which is capable of displaying images and/or videos.

The description of the disclosed embodiments is provided to illustrate the present invention to those skilled in the art. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A display panel, comprising:

a plurality of pixels arranged in a matrix, wherein:

each pixel includes a white sub-pixel, a red sub-pixel, a green sub-pixel and a blue sub-pixel arranged in a 2×2 array, the blue sub-pixel and the white sub-pixel are adjacently disposed in a same row of the array, and the red sub-pixel and the green sub-pixel are adjacently disposed in a same row of the array, the white sub-pixel has an irregular polygonal shape or a circular shape, with a switched-on rate of 70%-90%, and has a reduced effective aperture area compared with each of the red sub-pixel, the green sub-pixel and the blue sub-pixel, wherein the effective aperture area of a sub-pixel is an effective region capable of transmitting light there-through, the plurality of pixels includes a first pixel and a second pixel adjacent to the first pixel in a row direction of the pixel matrix, wherein sub-pixels having a same color in the first and second pixels are arranged in different rows and different columns of the pixel matrix, the blue sub-pixel and the red sub-pixel elongate along a first direction, along the first direction, a dimension of the effective aperture area of the red sub-pixel is at least 1.5 times greater than a dimension of the effective aperture area of the blue sub-pixel, and along a second direction perpendicular to the first direction, a dimension of the effective aperture area of the blue sub-pixel is at least 1.5 times greater than a dimension of the effective aperture area of the red sub-pixel.

2. The display panel according to claim 1, wherein:

the effective aperture area of the red sub-pixel, the effective aperture area of the green sub-pixel and the effective aperture area of the blue sub-pixel are the same.

3. The display panel according to claim 2, wherein:

the red sub-pixel and the green sub-pixel have a same shape and a same dimension.

4. The display panel according to claim 3, wherein:

the white sub-pixel, the red sub-pixel, the green sub-pixel and the blue sub-pixel have a same shape.

5. The display panel according to claim 1, wherein:

the blue sub-pixel and the red sub-pixel have different shapes.

6. The display panel according to claim 1, wherein:

the effective aperture area of the white sub-pixel has a polygonal shape or a circular shape.

7. The display panel according to claim 2, wherein:

in a row direction of the matrix, two blue sub-pixels in any two adjacent pixels are disposed in different rows and different columns.

8. The display panel according to claim 7, wherein:

in the row direction of the matrix, two white sub-pixels in any two adjacent pixels are disposed in different rows and different columns.

9. The display panel according to claim 8, wherein:

in one pixel, the white sub-pixel is disposed adjacent to the blue sub-pixel.

10. The display panel according to claim 1, wherein:

a ratio between an effective aperture length of the red sub-pixel and an effective aperture width of the red sub-pixel is 2:1 to 3.5:1; and a ratio between a full length of the red sub-pixel and a full width of the red sub-pixel is 2:1 to 3.5:1.

11. The display panel according to claim 1, wherein:

the effective aperture area of the sub-pixel is an area of the sub-pixel excluding opaque regions occupied by wires, light-shielding layers and thin film transistors, and a ratio between the effective aperture area of the blue sub-pixel and the effective aperture area of the white sub-pixel is 1:0.5.

12. The display panel according to claim 1, wherein:

sub-pixels in the first and second pixels are arranged in a 2×4 array; and the sub-pixels with the same color are substantially diagonally disposed in the 2×4 array.

13. The display panel according to claim 1, further including:

a plurality of pixel units, wherein one pixel unit of the plurality of pixel units includes the first and second pixels, including eight sub-pixels arranged in a 2×4 array.

14. A color film substrate, comprising:

a substrate having a plurality of pixels arranged in a matrix, and a light-shielding layer confining a plurality of sub-pixels in each of the plurality of pixels, wherein:

each pixel includes a white sub-pixel, a red sub-pixel, a green sub-pixel and a blue sub-pixel arranged in a 2×2 array, the blue sub-pixel and the white sub-pixel are adjacently disposed in a same row of the array, and the red sub-pixel and the green sub-pixel are adjacently disposed in a same row of the array, the white sub-pixel has an irregular polygonal shape or a circular shape, with a switched-on rate of 70%-90%, and has a reduced effective aperture area compared with each of the red sub-pixel, the green sub-pixel and the blue sub-pixel, wherein the effective aperture area of a sub-pixel is an effective region capable of transmitting light there-through, the plurality of pixels includes a first pixel and a second pixel adjacent to the first pixel in a row direction of the pixel matrix, wherein sub-pixels having a same color in the first and second pixels are arranged in different rows and different columns of the pixel matrix, the blue sub-pixel and the red sub-pixel elongate along a first direction, along the first direction, a dimension of the effective aperture area of the red sub-pixel is at least 1.5 times greater than a dimension of the effective aperture area of the blue sub-pixel, and along a second direction perpendicular to the first direction, a dimension of the effective aperture area of the blue sub-pixel is at least 1.5 times greater than a dimension of the effective aperture area of the red sub-pixel.

15. The color film substrate according to claim 14, wherein:

the effective aperture area of the red sub-pixel, the effective aperture area of the green sub-pixel and the effective aperture area of the blue sub-pixel are the same.

16. The color film substrate according to claim 14, further including:

a plurality of red color barriers, a plurality of green color barriers and a plurality of blue color barriers, wherein a red color barrier, a green color barrier and a blue color barrier are disposed on the red sub-pixel, the green sub-pixel and the blue sub-pixel, respectively, the red color barrier has an area equal to the effective aperture area of the red sub-pixel, the green color barrier has an area equal to the effective aperture area of the green sub-pixel, and the blue color barrier has an area equal to the effective aperture area of the blue sub-pixel.

17. The color film substrate according to claim 16, wherein:

a white color barrier is disposed on the white sub-pixel.

18. The color film substrate according to claim 16, wherein:

the red sub-pixel and the green sub-pixel have a same shape; and the red sub-pixel and the green sub-pixel have a same area.

19. The color film substrate according to claim 16, wherein:

in a row direction of the matrix, two blue sub-pixels in any two adjacent pixels are disposed in different rows and different columns, and two white sub-pixels in any two adjacent pixels are disposed in different rows and different columns.

20. A display device, comprising:

a display panel including a plurality of pixels arranged in a matrix, wherein:

each pixel includes a white sub-pixel, a red sub-pixel, a green sub-pixel and a blue sub-pixel arranged in a 2×2 array, the blue sub-pixel and the white sub-pixel are adjacently disposed in a same row of the array, and the red sub-pixel and the green sub-pixel are adjacently disposed in a same row of the array, the white sub-pixel has an irregular polygonal shape or a circular shape, with a switched-on rate of 70%-90%, and has a reduced effective aperture area compared with each of the red sub-pixel, the green sub-pixel and the blue sub-pixel, wherein the effective aperture area of a sub-pixel is an effective region capable of transmitting light there-through, the plurality of pixels includes a first pixel and a second pixel adjacent to the first pixel in a row direction of the pixel matrix, wherein sub-pixels having a same color in the first and second pixels are arranged in different rows and different columns of the pixel matrix, the blue sub-pixel and the red sub-pixel elongate along a first direction, along the first direction, a dimension of the effective aperture area of the red sub-pixel is at least 1.5 times greater than a dimension of the effective aperture area of the blue sub-pixel, and along a second direction perpendicular to the first direction, a dimension of the effective aperture area of the blue sub-pixel is at least 1.5 times greater than a dimension of the effective aperture area of the red sub-pixel.

* * * * *